US006375503B2

(12) United States Patent
Ohsumi

(10) Patent No.: US 6,375,503 B2
(45) Date of Patent: Apr. 23, 2002

(54) DOUBLE LOCKED TERMINAL CONNECTOR

(75) Inventor: Hideki Ohsumi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/741,017

(22) Filed: Dec. 21, 2000

(30) Foreign Application Priority Data

Dec. 27, 1999 (JP) ..... 11-370234

(51) Int. Cl.[7] ..... H01R 13/40
(52) U.S. Cl. ..... 439/595
(58) Field of Search ..... 439/595, 752, 439/599, 489, 358, 352

(56) References Cited

U.S. PATENT DOCUMENTS 5,061,197 A * 10/1991 Kuzuno et al. ..... 439/262
5,944,557 A * 8/1999 Fukuda ..... 439/595
6,048,226 A * 4/2000 Iwahori ..... 439/595
6,234,848 B1 * 5/2001 Sikora et al. ..... 439/752

* cited by examiner

*Primary Examiner*—Gary Paumen
*Assistant Examiner*—James R. Harvey
(74) *Attorney, Agent, or Firm*—Armstrong, Westerman & Hattori, LLP

(57) ABSTRACT

The connector includes a connector housing having a resilient locking arm for locking a terminal and a holder having an extended piece inserted into an insertion space of the connector housing. In an incomplete insertion state of the terminal, the locking arm deflects so that a free end surface of the locking arm protrudes from an inner wall of the insertion space to cause the extended piece to abut against the free end surface of the locking arm. Meanwhile, in a complete insertion state of the terminal, the extended piece is inserted into the insertion space to lie over the locking arm. The extended piece is longitudinally inclined toward the locking arm so that the extended piece can slidingly contact the inner wall of the insertion space. Preferably, the inner wall of the insertion space has an inclined portion at an intermediate portion of the inner wall for guiding the extended piece, and the free end surface of the locking arm is longitudinally positioned so as to cross the inclined portion when the locking arm is deflected.

4 Claims, 5 Drawing Sheets

DOUBLE LOCKED TERMINAL CONNECTOR

BACKGROUND OF THE INVENTION

1. Field of the Invention

The present invention relates to a double locked terminal connector having a holder. In an incomplete insertion state of a terminal into a housing of the connector, a locking arm for the terminal abuts against the holder, which notices the incomplete insertion of the terminal. In a complete insertion state of the terminal, the extended piece prevents the deflection of the terminal to double lock the terminal in the connector housing.

2. Related Art

FIGS. 5 to 8 show a known double locked terminal connector.

As illustrated in FIG. 5, the double locked terminal connector 40 has a plug connector housing 41 made of a synthetic resin material, a receptacle terminal 28 connected to an electrical wire, and a front holder 42 made of a synthetic resin material. The terminal 28 is inserted from a rear opening of the connector housing 41 into a terminal accommodation chamber 17. The holder engages with a forward end portion of the connector housing 41 and locks the terminal 28 in the connector housing 41.

The connector housing 41 has a resilient locking arm 5 formed therein. The locking arm 5 has a lock protrusion 13 which is protruding into the terminal accommodation chamber 17 when the locking arm 5 is free. In a complete insertion state of the terminal 28 into the terminal accommodation chamber 17, the protrusion 13 of the locking arm 5 can engage with a locking opening (not shown) formed in a base portion 30 of the terminal 28. The base portion 30 has a box-shaped electrical connection portion 29 unitarily formed therewith at one side thereof. The electrical connection portion 29 has a resilient contact piece (not shown) formed therein. The base portion 30 has an electrical wire connection portion (crimping portion) 43 at the other side thereof.

In FIG. 5, the terminal 28 is in a half insertion state. The protrusion 13 of the locking arm 5 abuts against the base portion 30 of the terminal 28, so that the locking arm 5 is deflecting toward a deflection space 22 formed in the connector housing 41. The connector housing 41 is formed with an insertion space 44 of a hollow or a channel shape for receiving the front holder 42. The insertion space 44 is extending toward a fore side of the connector housing 41 so as to be contiguous to the deflection space 22.

The front holder 42 is of a substantially rectangular frame shape. The holder 42 has an extended piece 45 of a small width plate which can be inserted into the insertion space 44. The extended piece 45 extends from a front wall 8 of the holder 42 in a longitudinal direction of the housing inside a frame wall 7 of the holder 42. The frame wall 7 engages with a forward outer surface of the connector housing 41. Optionally, the connector housing 41 has a hood (not shown) unitarily formed with the housing 41 with a clearance from an outer surface of the housing 41. The front holder 42 slides into and engages with the connector housing 41 opposite to the terminal insertion direction.

As illustrated in FIG. 5, in an incomplete insertion state of the terminal 28, a fore end of the locking arm 5 which is deflecting abuts against the tip of the extended piece 45. This prevents a further advancement of the front holder 42 to notice the incomplete insertion of the terminal 28.

Meanwhile, in a complete insertion state of the terminal 28 into the terminal accommodation chamber 17, the protrusion 13 of the locking arm 5 enters the electrical connection portion 29 of the terminal 28, so that the locking arm 5 returns to its free position. Thus, the extended piece 45 does not abuts against the locking arm 5 to advance into the insertion space 44, so that the extended piece 45 prevents the movement of the locking arm 5 to lock the terminal 28. That is, the extended piece 45 serves to inspect an incomplete insertion state of the terminal 28 and also to lock the terminal 28. The extended piece 45 described above prevents the movement of the locking arm 5 to surely lock the terminal. In another example of a terminal double locking connector (not shown), an extended piece directly locks a shoulder 46 of the electrical connection portion 29 of the terminal 28.

FIG. 6 shows a preliminary engaging state of the front holder 42 with the connector housing 41, and FIG. 7 shows a complete engaging state of the front holder 42 with the connector housing 41.

For the front holder 42 and the connector housing 41, there are provided a preliminary locking means and a final locking means (not shown). The preliminary locking means consists of a preliminary locking protrusion and a preliminary lock opening. The final locking means consists of another locking protrusion and another lock opening. In the preliminary engaging state of the front holder 42 of FIG. 6, the terminal accommodation chamber 17 receives the terminal 28 (FIG. 5).

After the insertion of the terminal, the front holder 42 is pushed toward the terminal side to engage with the connector housing 41. Then, the front holder 42 becomes in a finally locked state as illustrated in FIG. 7. In the finally locked state, the extended piece 45 limits the movement of the locking arm 5.

However, in the above-mentioned constitution, as illustrated in FIG. 8, the position of the extended piece 45 is unstable within the insertion space 44 when the terminal 28 is incompletely inserted into the connector housing 41. Furthermore, there are dimensional tolerances of the extended piece 45 and the insertion space 44 to cause an inadequate looseness between them. Thus, the position of the extended piece 45 is variable within the insertion space 44, so that the fore end of the locking arm 5 which is deflecting abuts against the extended piece 45 with a variable abutment area. As illustrated in FIG. 8, there is no problem when the best abutting distance A is achieved. However, when the locking arm 5 abuts against the extended piece 45 with the smallest abutting distance B, the locking arm 5 may be pushed toward the terminal side. This enlarges a clearance 47 of the insertion space 44 to release the extended piece 45 from the locking arm 5. Thus, there is the disadvantage that the extended piece 45 unintentionally advances into the insertion space 44.

Furthermore, in a final locking state of the front holder 42 as illustrated in FIG. 7, there may be a variable clearance 48 between the locking arm 5 and the extended piece 45 due to the variable position of the extended piece 45. Thus, the locking arm 5 tends to deflect so that the locking arm 5 disadvantageously provides a reduced locking force on the terminal. The reduced locking force may disengage the terminal 28 from the connector housing 41. These disadvantages of the front holder 42 are found also when a rear holder (not shown) is coupled to a rear portion of a connector housing to limit the movement of a locking arm for locking a terminal. In this connector, the locking arm is extending rearward.

SUMMARY OF THE INVENTION

In view of the disadvantages, an object of the present invention is to provide a double locked terminal connector in which an incomplete insertion state of a terminal is reliably recognized. In an incomplete insertion state of the terminal in a connector housing, a fore end of a locking arm surely abuts against an extended piece of a holder.

For achieving the object, a double locked terminal connector according to the invention includes a connector housing having a resilient locking arm for locking a terminal. The connector also includes a holder having an extended piece inserted into an insertion space of the connector housing. In an incomplete insertion state of the terminal, the locking arm deflects so that a free end surface of the locking arm protrudes from an inner wall of the insertion space to cause the extended piece to abut against the free end surface of the locking arm. Meanwhile, in a complete insertion state of the terminal, the extended piece is inserted into the insertion space to lie over the locking arm. The extended piece is longitudinally inclined toward the locking arm so that the extended piece can slidingly contact the inner wall of the insertion space.

Preferably, the inner wall of the insertion space has an inclined portion at an intermediate portion of the inner wall for guiding the extended piece. The free end surface of the locking arm is positioned so as to cross a longitudinally mid or inner end point of the inclined portion when the locking arm is deflected.

Preferably, in an initial insertion state of the holder in the connector housing, the extended piece is positioned at a widened entrance of the insertion space. The widened entrance is contiguous to the insertion space. A forward end of the extended piece resiliently contacts a portion of the inner wall of the insertion space when the holder is inserted. The portion is contiguous to the inner end of the inclined portion.

Preferably, the forward end surface of the extended piece is inclined parallel to the free end surface of the locking arm.

DETAILED DESCRIPTION OF THE PREFERRED EMBODIMENT

Figure 2B:
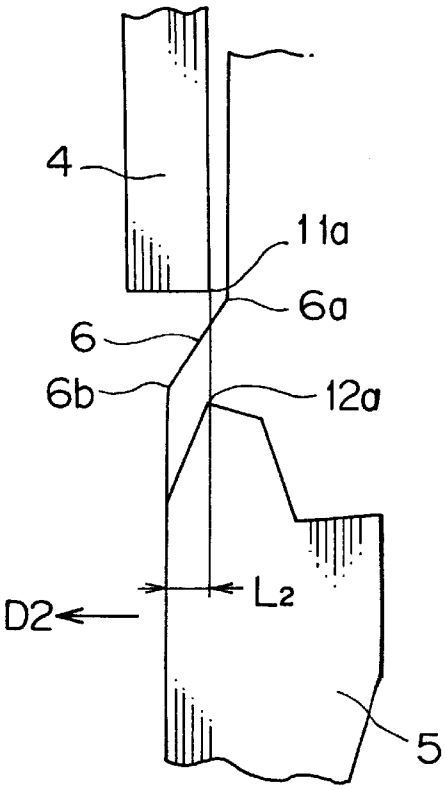
FIGS. 2A and 2B each are a view illustrating a moving step of a locking arm.

Referring to the accompanied drawings, an embodiment of the present invention will be discussed in detail. Components the same as those of the prior art are designated by the same reference numerals as those of the prior art and will not be discussed again. FIGS. 1 to 4 show the embodiment.

Figure 1:
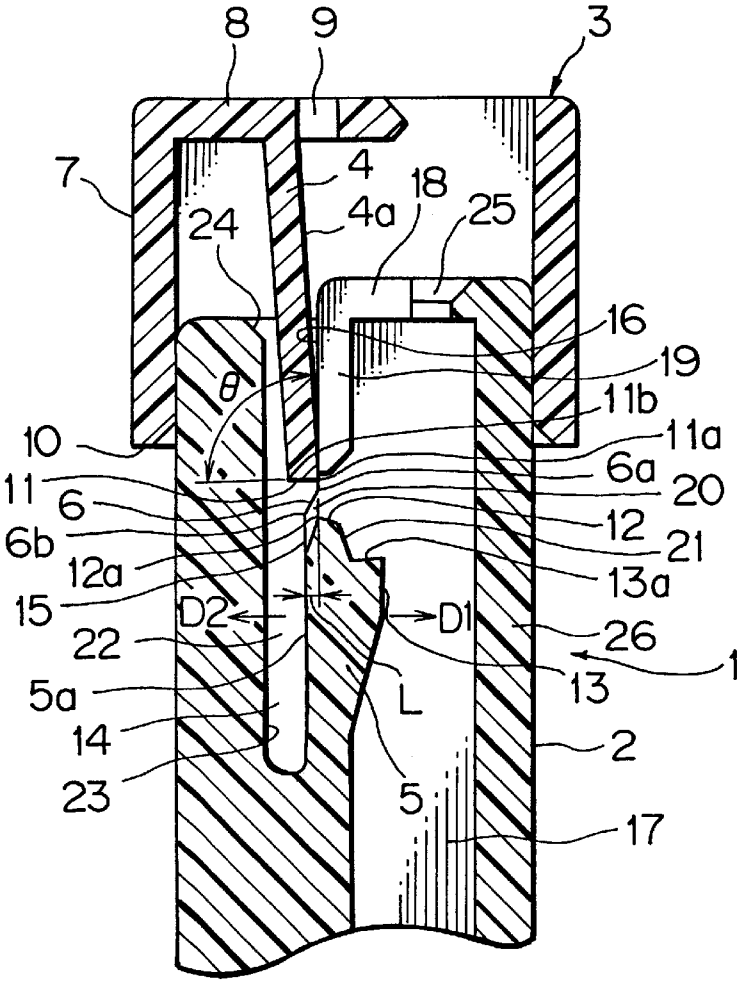
FIG. 1 is a longitudinal sectional view showing an embodiment of a double locked terminal connector according to the present invention.

As illustrated in FIG. 1, a double locked terminal connector 1 has a connector housing 2 made of a synthetic resin material and having a resilient arm 5 for locking a terminal. The connector also has a front holder 3 made of a synthetic resin material and engaging with a fore end portion of the connector housing 2. The front holder 3 has an extended piece 4 consisting of a flat plate or a bar for inspecting an incomplete insertion state of the terminal and also for double locking the terminal. The extended piece 4 inclines in a direction shown by an arrow head D1 when the extended piece 4 is in a free position thereof. The connector housing 2 is formed with a tapered surface (or an inclined portion) 6 for guiding a fore end portion of the extended piece 4 in a direction shown by an arrow head D2.

The front holder 3 has a frame wall 7 of a rectangular shape. The extended piece 4 is positioned inside the frame wall 7 and extends from a front wall 8 of the holder opposite to the terminal insertion direction (that is, in the engagement direction of the front holder). The extended piece 4 slightly inclines longitudinally as described above. The extended piece 4 is easily defined by using a mold removing hole 9 provided in the front wall 8 of the front holder 3 when the front holder 3 is molded from a synthetic resin.

The forward end of the extended piece 4 extends longitudinally a little longer than the fore end 10 of the frame wall 7. A forward end surface 11 of the extended piece 4 is substantially perpendicular to the holder engagement direction in a preliminary engagement state (initial insertion state) of the front holder as illustrated in FIG. 1. The forward end surface 11 of the extended piece 4 may be slightly inclined so as to be parallel to the fore end surface 12 of the locking arm 5. More specifically, in FIG. 1, a forward edge (first edge) 11*a* of the forward end surface 11, which is positioned in the side of the locking arm, may be positioned slightly forward from the other edge (second edge) 11*b* of the forward end surface 11 in the front holder insertion direction. Since the forward end surface 11 aligns with a line passing through both the edges 11*a*, 11*b*, the first edge 11*a*, which is a cross point of the forward end surface 11 and a side surface 4*a* of the extended piece 4, has an angle θ less than 90°.

In FIG. 1, the first edge 11*a* of the extended piece 4 is positioned inside an inner wall 15 of the connector housing 2 by a distance L. An outer surface 5*a* of the locking arm 5 aligns with the inner wall 15. The inner wall 15 partially defines an insertion space 14 for the extended piece 4. The insertion space is a slot or a channel. The inner wall 15 is contiguous to another inner wall 16 positioned at an entrance side of the insertion space 14 through the inclined surface 6.

The inner wall 16 aligns with an outer surface of a partition wall 19 depending from a front wall 18 of a terminal accommodation chamber 17 of the connector housing 2. The partition wall 19 has a fore end opposing to the free end surface 12 of the locking arm 5 with a clearance 20 therebetween. The entrance side inner wall 16 extends slightly forward from the extended piece 4 of the front holder toward a fore end 12*a* of the locking arm 5; when the front holder is in a preliminary engagement state. As described above, the entrance side inner wall 16 is contiguous to the inclined surface 6. The inclined surface 6 is contiguous to the inner wall 15 of the insertion space 14 at a point that is positioned longitudinally near the fore end 12*a* of the locking arm 5.

In FIG. 1 which shows a preliminary engagement state of the front holder, the first edge 11*a* of the extended piece 4 is lightly contacting the entrance side inner wall 16 at a point that is positioned a little forward from a base end 6*a* of the inclined surface 6.

The first edge 11*a* of the forward end surface 11 of the extended piece 4 may not contact the entrance side inner wall 16 of the insertion space 14. In FIG. 2A, when the locking arm 5 deflects in the arrow head direction D2, the fore end 12*a* of the locking arm 5 moves to cross the inclined surface 6 of the insertion space 14. For example, the cross point is positioned laterally outside the first edge 11*a* of the extended piece 4 by a distance L1.

Figure 2A:
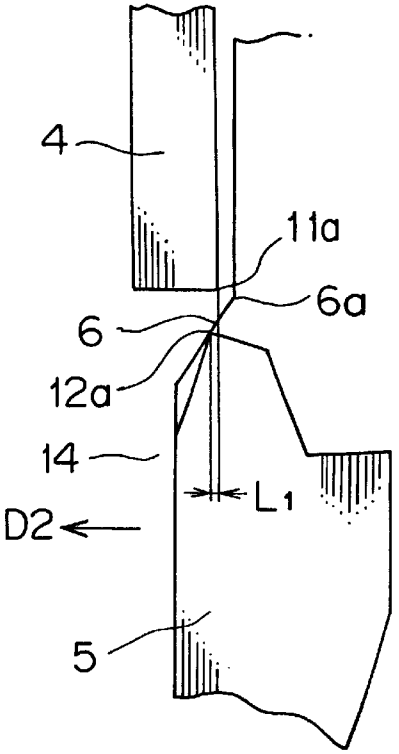

Alternatively, as illustrated in FIG. 2B, when the fore end 12*a* of the locking arm 5 moves not to cross the inclined surface 6, the first edge 11*a* of the extended piece 4 is determined to be laterally positioned between the base end 6*a* and a distal end 6*b* of the inclined surface 6. In every case, the first edge 11*a* of the extended piece 4 need be positioned in the side of the base end 6*a* of the inclined surface 6.

As illustrated in FIG. 1, the locking arm 5 has a lock protrusion 13 that is contiguous to the free end surface 12 gently inclined toward the fore end 12*a*. The free end surface 12 is contiguous to an abutment surface 13*a* of the protrusion 13 via a steeply inclined surface 21. Meanwhile, the fore end 12*a* of the locking arm 5 is contiguous to an surface inclined outward, and the inclined surface is contiguous to the outer surface 5*a*. The outer surface 5*a* turns back at a base portion of the locking arm 5 to lead to another inner wall 23 of the insertion space 14. The inner wall 23 extends straight to lead to a chamfered guide surface 24 positioned at an entrance of the connector housing 2. Note that the insertion space 14 partially overlaps with a deflection space 22 of the locking arm 5.

The front wall 18 of the terminal accommodation chamber 17 of the connector housing 2 has an insertion hole 25 for an opposing pin terminal (not shown). The front wall 18 is contiguous with an outer wall 26 of the accommodation chamber 17. The outer wall 26 is opposed to the partition wall 19. The partition wall 19 has a cutout to allow the deflection of the locking arm.

In a preliminary engagement state of the front holder 3 as illustrated in FIG. 1, the terminal accommodation chamber 17 receives the terminal 28 (FIG. 3), and then, the front holder 3 is inserted into the connector housing 2 opposite to the terminal insertion direction. The first edge 11*a* of the forward end surface 11 of the extended piece 4 slides on the inner wall 16 and on the inclined surface 6 within the insertion space 14. The first edge 11*a* further slidingly advances from the inclined surface along the inner wall 15. Thus, the extended piece 4 is smoothly received in the insertion space 14.

Figure 3:
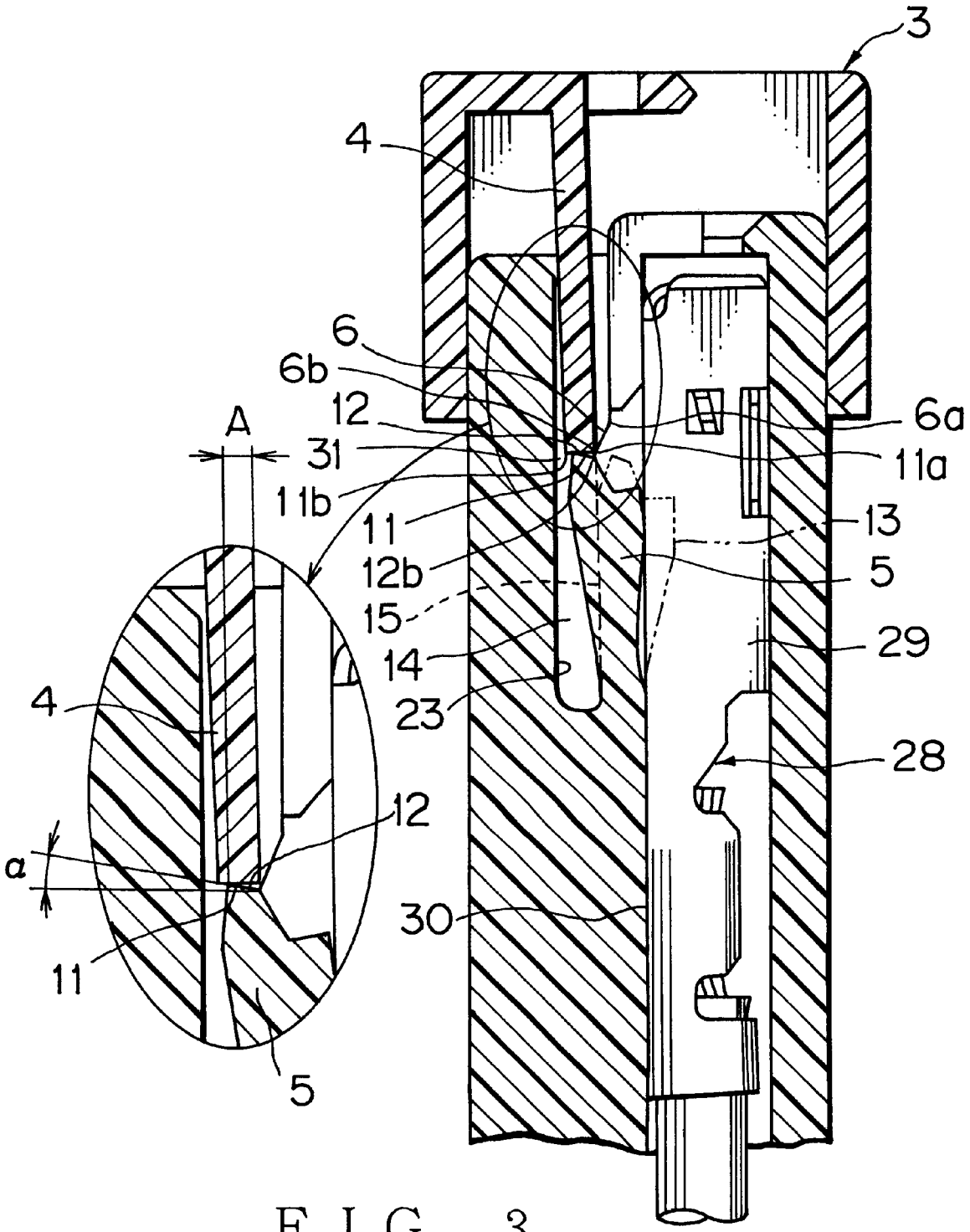
FIG. 3 is a longitudinal sectional view showing a state in which a front holder is abutting against the locking arm in a terminal incomplete insertion state.
Figure 6:
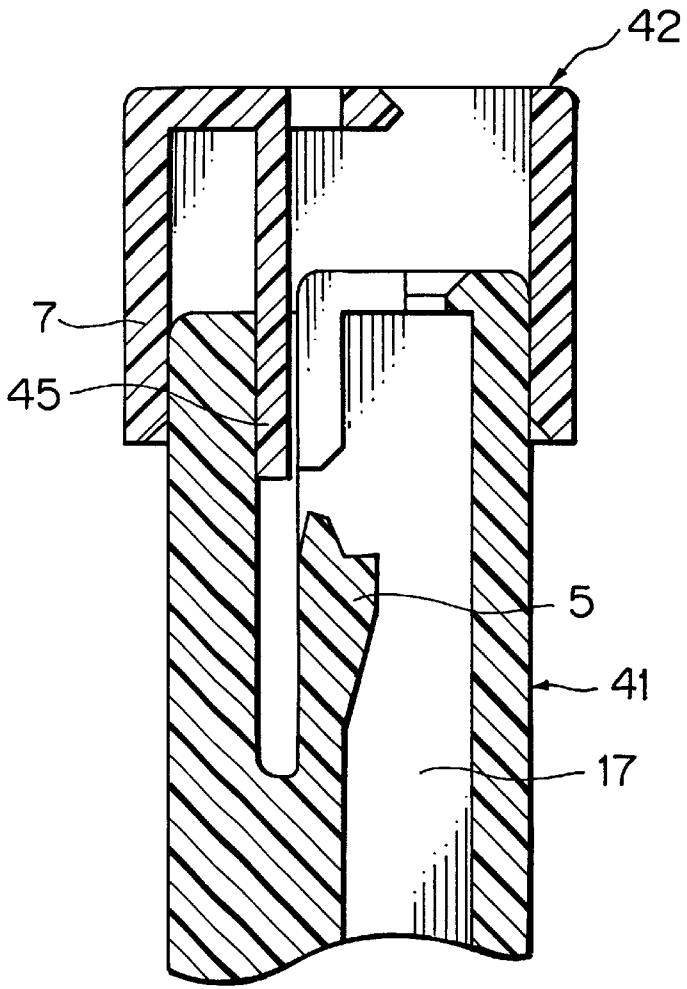
PRIOR ART FIG. 6
FIG. 6 is a longitudinal sectional view showing an initial insertion state of the front holder of FIG. 5.

As illustrated in FIG. 3, in an incomplete insertion state of the terminal 28, the lock protrusion 13 of the locking arm 5 abuts against a base portion 30 of a box-shaped electrical connection portion 29 of the terminal 28. Thereby, the locking arm 5 deflects into the insertion space 14, so that the free end surface 12 of the locking arm 5 is moved to outwardly project from the distal end 6*b* of the inclined surface 6 of the insertion space 14. The first edge 11*a* of the forward end surface 11 of the extended piece 4 moves slidingly along the inclined surface 6, so that the extended piece 4 deflects outward. When the first edge 4*a* has reached substantially the distal end of the inclined surface 6, the forward end surface 11 of the extended piece 4 abuts against the free end surface 12 of the locking arm 5 with a sufficient abutment area.

Regarding the thus deflected locking arm 5, an edge 12*b* of the free end surface 12 is longitudinally positioned to align with the distal end 6*b* of the inclined surface 6. That is, the inclined surface 6 is determined in its angle and position such that the edge 12*b* of the deflected locking arm 5 aligns with the inner wall 15 of the insertion space 14. Hence, the free end surface 12 of the locking arm 5 abuts against the forward end surface 11 of the extended piece 4 with the maximum abutment distance A. Accordingly, the extended piece 4 surely abuts against the locking arm 5, allowing a reliable detection of the incomplete insertion of the terminal 5.

When the first edge 11*a* of the forward end surface 11 of the extended piece 4 slides on the inner wall 15 of the insertion space 14, there is a clearance 31 between the other edge 11*b* of the forward end surface 11 of the extended piece 4 and the other inner wall 23 of the insertion space 14. The locking arm 5 may be a little shorter so that there is a distance between the free end surface 12 and the inclined surface 6. Nevertheless, the edge 12*b* of the free end surface 12 aligns with the inner wall 15 of the insertion space 14. The inclined surface 6 guides the forward end surface 11 of the extended piece 4, so that the forward end surface 11 abuts against the free end surface 12 of the locking arm 5 with the maximum abutment distance A. That is, the shortened locking arm 5 provides the same advantage as the previously described one.

As illustrated in FIG. 3, the fore end of the extended piece 4 moves along the inclined surface 6 to contact the inner wall 15 of the insertion space 14. In this state, the extended piece 4 is slightly pivoting outward. Thereby, the forward end surface 11 of the extended piece 4 has an incline angle α larger than that of a preliminary engagement state of the holder 3 of FIG. 1. The forward end surface 11 having the larger inclined angle aligns and fits with an inclined angle of the free end surface 12 of the locking arm 5. Thereby, the locking arm 5 can reliably abut against the extended piece 4 with no slide therebetween.

Figure 4:
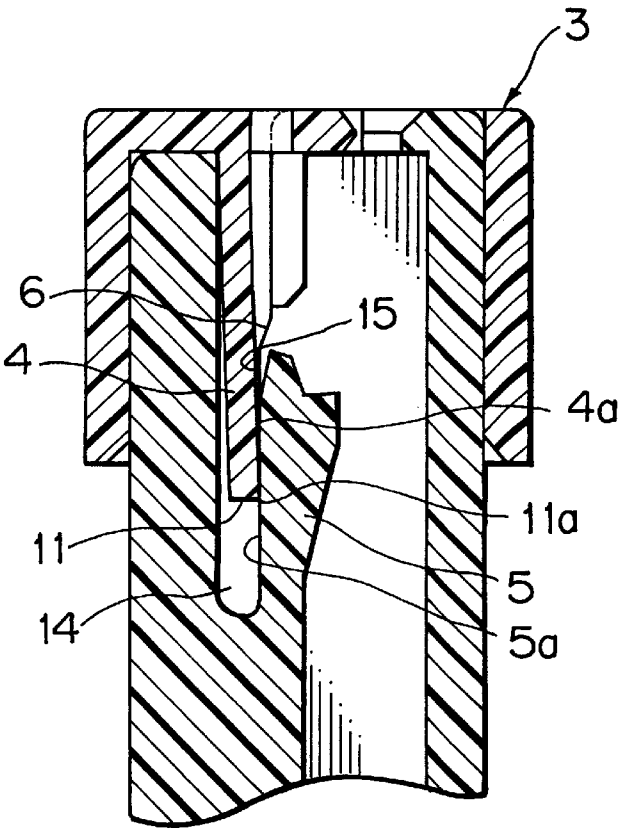
FIG. 4 is a longitudinal sectional view showing the front holder which has been pushed into a connector housing.
Figure 5:
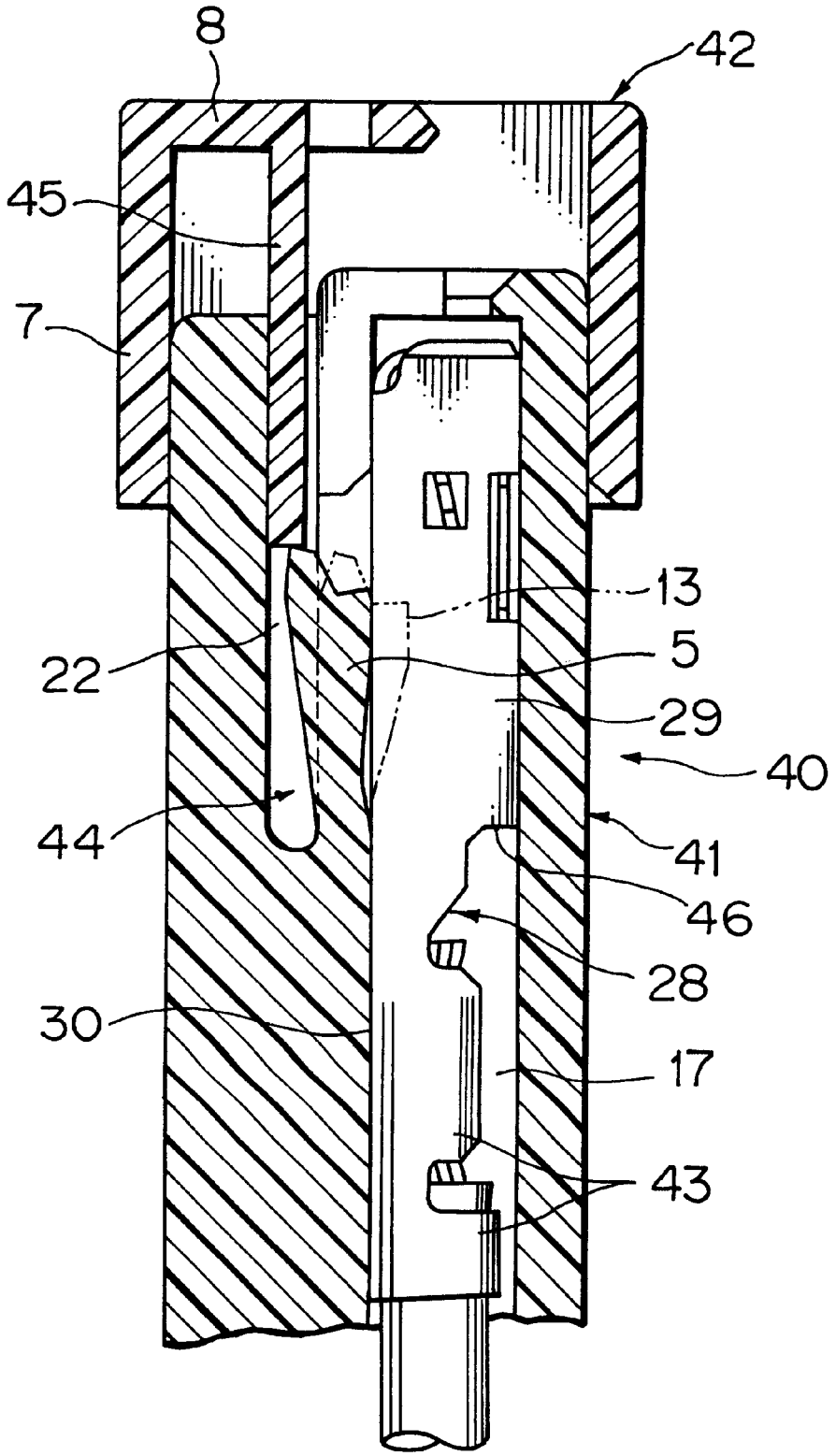
PRIOR ART FIG. 5
FIG. 5 is a longitudinal sectional view showing a known double locked terminal connector which is in a terminal incomplete insertion state.

In a preliminary engagement state of the front holder 3 of FIG. 1, when the connector housing 2 has completely received the terminal 28 (FIG. 3), the lock protrusion 13 of the locking arm 5 engages with the electrical connection portion 29 of the terminal 28. Thus, the locking arm 5 is in a normal straight position so that, as illustrated in FIG. 4, the first edge 11*a* of the forward end surface 11 of the extended piece 4 slides on the inner wall 15 of the insertion space 14. Accordingly, the extended piece 4 smoothly moves into the insertion space 14.

Furthermore, in the preliminary engagement state of the front holder 3 of FIG. 1, the extended piece 4 is initially inclined inward, and the fore end of the extended piece 4 is lightly contacting the inner wall 16 positioned in an entrance side of the insertion space 14. As illustrated in FIG. 4, the fore end of the extended piece 4 slides on the inclined surface 6 of the insertion space 14 to deflect outward. This provides an inward resilient force to the extended piece 4. In FIG. 4, the front holder 3 is locked to the connector housing 2 by the locking means (not shown) consisting of the lock protrusion and the locking hole.

As described above, in the embodiment, the extended piece 4 of the front holder 3 is inclined laterally inward. The first edge 11*a* of the forward end surface 11 of the extended piece 4 is initially positioned laterally inward as compared with the inner wall 15 of the insertion space 14 of the connector housing 2. The insertion space 14 of the connector housing 2 has the inclined surface 6 guiding laterally outward the forward end of the extended piece 4. When the locking arm is outwardly deflecting, the free end surface 12 of the locking arm 5 is positioned laterally outward as compared with the distal end 6*b* of the inclined surface 6 to project outwardly from the inner wall 15 of the insertion space 14. Accordingly, the forward end surface 11 of the extended piece 4 is engageable with the free end surface 12 of the locking arm 5 with the maximum abutting length A (FIG. 3).

Figure 8:
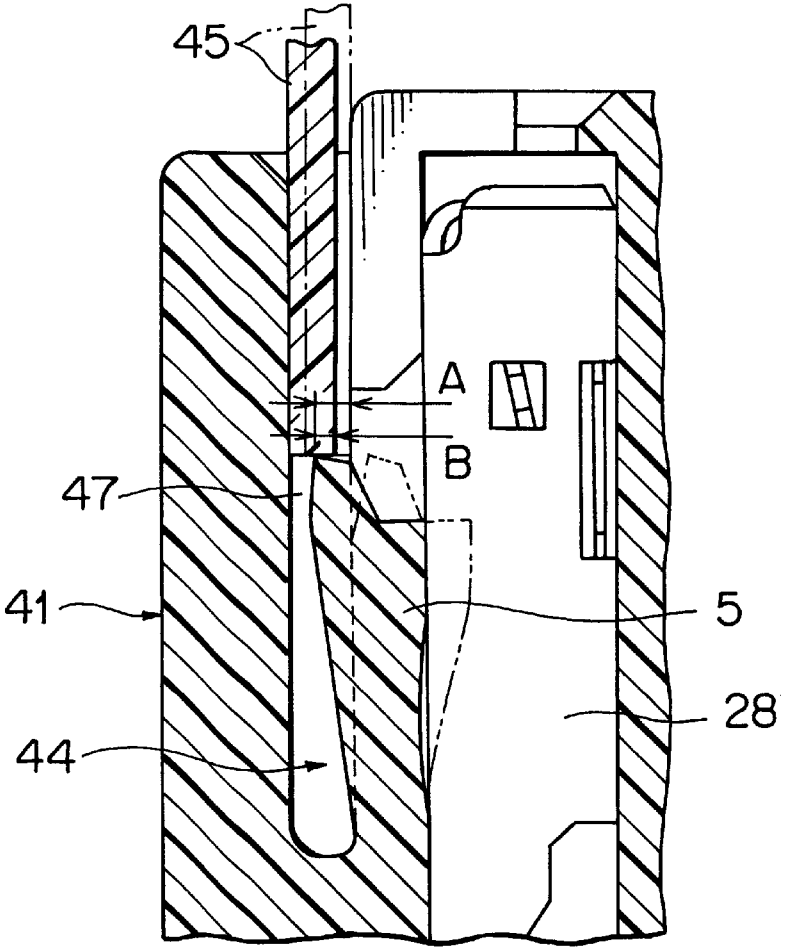
PRIOR ART FIG. 8
FIG. 8 is a view illustrating the front holder of FIG. 5 with a terminal incomplete insertion state.
Figure 7:
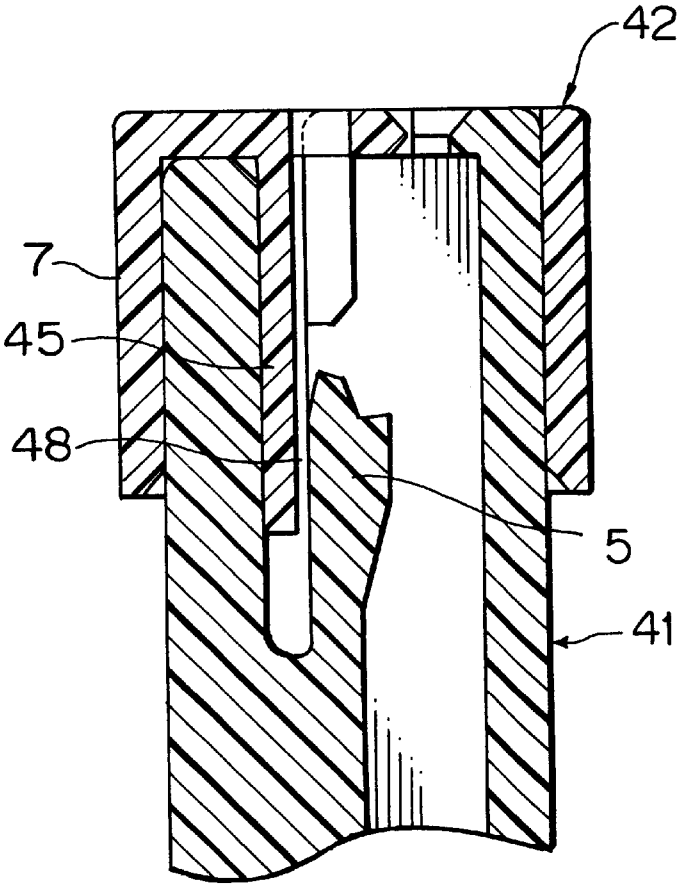
PRIOR ART FIG. 7
FIG. 7 is a longitudinal sectional view showing a complete engaging state of the front holder of FIG. 5.

Note that the extended piece 4 of the extended piece 4, which is inclined laterally outward, could slide along the inner wall 15 of the insertion space 14 without the inclined surface 6. This is also advantageous as compared with the prior art (FIG. 8). In this case, the inner wall 15 of the insertion space 14 extends straight, and the forward end of the extended piece 4 resiliently abuts against the inner wall 15 with the front holder 3 being in a preliminary engagement state.

Meanwhile, the insertion space 4 having the inclined surface 6 provides a wider entrance of the insertion space 14. Thus, in a preliminary engagement state (initial insertion state) of the front holder 3, the forward end of the extended piece 41 lightly contacts an entrance side of the inner wall 16. Thereby, the extended piece 4 is initially inserted into the entrance side of the insertion space 14, allowing an easy initial insertion of the front holder 3.

Furthermore, when the locking arm 5 is deflecting so that the free end surface 12 is considerably projecting outward from the inner wall 15 of the insertion space 14, the edge 12*b* of the free end surface 12 may be spaced from the inner wall 15. However, the forward end surface 11 of the extended piece 4 surely abuts against the free end surface 12 of the locking arm with no problem. The front holder 3 of the embodiment may be replaced by a rear holder (not shown) having a similar configuration.

Next, operational effects of the present invention will be discussed. As described above, according to the basic first aspect of the invention, the extended piece is initially inclined laterally inward, so that the forward end surface of the extended piece surely engages with the free end surface of the locking arm when the locking arm is deflecting in a terminal incomplete insertion state. Furthermore, the forward end of the extended piece slides along the inner wall of the insertion space, so that the forward end surface of the extended piece is adequately positioned. Thereby, relative to the free end surface of the locking arm, the forward end surface of the extended piece is correctly positioned, allowing a sure abutment of the end surfaces. Accordingly, an incomplete insertion of the terminal could be reliably recognized.

According to another feature of the invention, at the insertion of the holder, the forward end of the extended piece slides on the inclined portion of the insertion space toward the free end surface of the locking arm which is deflecting in the terminal incomplete insertion state. Accordingly, the extended piece surely abuts against the locking arm.

According to further another feature of the invention, when the holder is initially inserted into the connector housing, the widened entrance of the insertion space smoothly receives the inclined extended piece. This allows an easy initial insertion of the holder. The holder is further pushed into the connector housing, so that the forward end of the extended piece smoothly moves along the inclined portion toward the back of the inner wall of the insertion space. In addition, the extended piece resiliently contacts the inner wall, so that the fore end of the extended piece is more correctly positioned. Thereby, the fore end of the extended piece engages more precisely with the free end surface of the locking arm in a terminal incomplete insertion state. Moreover, when the forward end surface of the extended piece abuts against the free end surface of the locking arm, the extended piece is urged laterally inward by its resiliency. Thus, the forward end surface of the extended piece can surely align with the locking arm with the maximum engagement area.

According to further another feature of the invention, the forward end surface of the extended piece is inclined parallel to the free end surface of the locking arm. In a terminal incomplete insertion state, the forward end surface of the extended piece surely abuts against the free end surface of the locking arm with no slide therebetween. Accordingly, the incomplete insertion of the terminal is reliably recognized.

What is claimed is:

1. A double locked terminal connector comprising:

a connector housing having a resilient locking arm for locking a terminal, a holder having an extended piece insertable into an insertion space formed in the connector housing, the insertion space partially overlapping with a deflection space of the locking arm, and an inner wall extending the length of the insertion space, wherein, in an incomplete insertion state of the terminal, the locking arm deflects so that a free end surface of the locking arm protrudes from the inner wall of the insertion space to cause the extended piece to abut against the free end surface of the locking arm, while, in a complete insertion state of the terminal, the extended piece is inserted into the insertion space to lie over the locking arm, and the extended piece is longitudinally inclined toward the locking arm so that the extended piece can slidingly contact the inner wall of the insertion space until a forward end of the extended piece abuts against the free end surface of the locking arm at the incomplete insertion state of the terminal.

2. The connector set forth in claim 1 wherein the forward end surface of the extended piece is inclined parallel to the free end surface of the locking arm when in an incomplete insertion state of the terminal and the forward end surface of the extended piece is abutting the free end surface of the locking arm.

3. A double locked terminal connector comprising:

a connector housing having a resilient locking arm for locking a terminal; and a holder having an extended piece insertable into an insertion space formed in the connector housing, the insertion space partially overlapping with a deflection space of the locking arm; wherein, in an incomplete insertion state of the terminal, the locking arm deflects so that a free end surface of the locking arm protrudes from an the inner wall of the insertion space to cause the extended piece to abut against the free end surface of the locking arm, while, in a complete insertion state of the terminal, the extended piece is inserted into the insertion space to lie over the locking arm, and the extended piece is longitudinally inclined toward the locking arm so that the extended piece can slidingly contact the inner wall of the insertion space; and the inner wall of the insertion space has an inclined portion at an intermediate portion of the inner wall for guiding the extended piece, and the free end surface of the locking arm is longitudinally positioned to cross a longitudinally mid or inner end point of the inclined portion when the locking arm is deflected.

4. The connector set forth in claim 3 wherein, in an initial insertion state of the holder into the connector housing, the extended piece is positioned at a widened entrance of the insertion space, the widened entrance being contiguous to the insertion space, a forward end of the extended piece resiliently contacting a portion of the inner wall of the insertion space when the holder is inserted, the portion being contiguous to a base end of the inclined portion of the inner wall.

* * * * *